US010310437B2

(12) United States Patent
Ohashi

(10) Patent No.: US 10,310,437 B2
(45) Date of Patent: Jun. 4, 2019

(54) DRUM UNIT AND IMAGE FORMING APPARATUS

(71) Applicant: KYOCERA Document Solutions Inc., Osaka (JP)

(72) Inventor: Hiroaki Ohashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/968,060

(22) Filed: May 1, 2018

(65) Prior Publication Data

US 2018/0335745 A1 Nov. 22, 2018

(30) Foreign Application Priority Data

May 19, 2017 (JP) ..... 2017-099829

(51) Int. Cl.

| | |
|---|---|
| ***H05B 3/00*** | (2006.01) |
| ***G03G 15/00*** | (2006.01) |
| *G03G 21/20* | (2006.01) |

(52) U.S. Cl.

CPC ..... *G03G 15/751* (2013.01); *G03G 21/203* (2013.01); *H05B 3/0014* (2013.01)

(58) Field of Classification Search

CPC ..... G03G 15/75; G03G 15/751; G03G 21/20; G03G 21/203

See application file for complete search history.

(56) References Cited

U.S. PATENT DOCUMENTS

| | | | | |
|---|---|---|---|---|
| 3,804,512 | A * | 4/1974 | Komori | G03G 15/30 271/160 |
| 5,130,751 | A * | 7/1992 | Sato | G03G 15/751 399/117 |
| 2010/0290802 | A1* | 11/2010 | Cavill | G03G 15/751 399/90 |
| 2011/0222931 | A1* | 9/2011 | Shinshi | G03G 15/2064 399/329 |
| 2014/0233977 | A1* | 8/2014 | Gyotoku | G03G 21/20 399/96 |
| 2016/0306316 | A1* | 10/2016 | Saito | G03G 21/0011 |

FOREIGN PATENT DOCUMENTS

| | | | |
|---|---|---|---|
| JP | 2002-040876 | A | 2/2002 |
| JP | 2006154648 | A * | 6/2006 |
| JP | 2008158126 | A * | 7/2008 |
| JP | 2009009033 | A * | 1/2009 |
| JP | 2009080362 | A * | 4/2009 |

OTHER PUBLICATIONS

Machine Translation of JP-2006154648-A. Jun. 15, 2006. (Year: 2006).*

* cited by examiner

*Primary Examiner* — Carla J Therrien
(74) *Attorney, Agent, or Firm* — Studebaker & Brackett PC

(57) ABSTRACT

A drum unit includes a photosensitive drum and a heater. The photosensitive drum rotates around a rotation axis extending along a rotation axis direction. The heater is installed inside the photosensitive drum and heats the photosensitive drum. The heater includes a heater substrate and a plurality of resistance elements. The heater substrate extends along the rotation axis direction. The plurality of resistance elements are aligned in the rotation axis direction and are mounted on the heater substrate.

7 Claims, 9 Drawing Sheets

DRUM UNIT AND IMAGE FORMING APPARATUS

INCORPORATION BY REFERENCE

This application is based on and claims the benefit of priority from Japanese patent application No. 2017-099829 filed on May 19, 2017, which is incorporated by reference in its entirety.

BACKGROUND

The present disclosure relates to a drum unit including a photosensitive drum and an image forming apparatus including the drum unit.

In a conventional electrographic image forming apparatus, an electrostatic latent image is formed on a surface of a charged photosensitive drum, and then the electrostatic latent image is developed by a toner to form a toner image. When the surface of the photosensitive drum is charged as described above, a discharge product may adhere on the surface of the photosensitive drum. If the discharge product absorbs moisture, an electrical resistance of the surface of the photosensitive drum is lowered, and failure called as an image flow may occur.

In order to avoid the occurrence of the image flow, a configuration to heat the photosensitive drum by a heater and to evaporate the moisture adhered on the surface of the photosensitive drum is well known. When such a configuration is applied, in order to heat the photosensitive drum intensively, the heater is preferably installed inside the photosensitive drum.

For example, conventionally, a drum heater, which includes a heating coil arranged on an insulation sheet, is rolled, and the rolled drum heater is inserted in an inside of the photosensitive drum. Flanges are forcefully inserted in both ends of the photosensitive drum, and a terminal for supplying electrical power to the drum heater is mounted on one of the flanges. An electrode always comes into contact with a circumferential face of an electrode plate coupled to the terminal, and the electrical coupling is kept during the rotation of the photosensitive drum.

SUMMARY

In accordance with an aspect of the present disclosure, a drum unit includes a photosensitive drum and a heater. The photosensitive drum rotates around a rotation axis extending along a rotation axis direction. The heater is installed inside the photosensitive drum and heats the photosensitive drum. The heater includes a heater substrate and a plurality of resistance elements. The heater substrate extends along the rotation axis direction. The plurality of resistance elements are aligned in the rotation axis direction and are mounted on the heater substrate.

In accordance with an aspect of the present disclosure, an image forming apparatus includes the drum unit and an apparatus main body to which the drum unit is attached.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, an image forming apparatus 1 according to one embodiment of the present disclosure will be described. Arrows Fr, Rr, L, R, U and Lo shown in each figure respectively indicate a front side, a rear side, a left side, a right side, an upper side and a lower side of the image forming apparatus 1.

First, an entire structure of the image forming apparatus 1 will be described. The image forming apparatus 1 is a multifunctional peripheral including multi functions, such as a printing function, a copying function and a facsimile function, for example.

Figure 1:
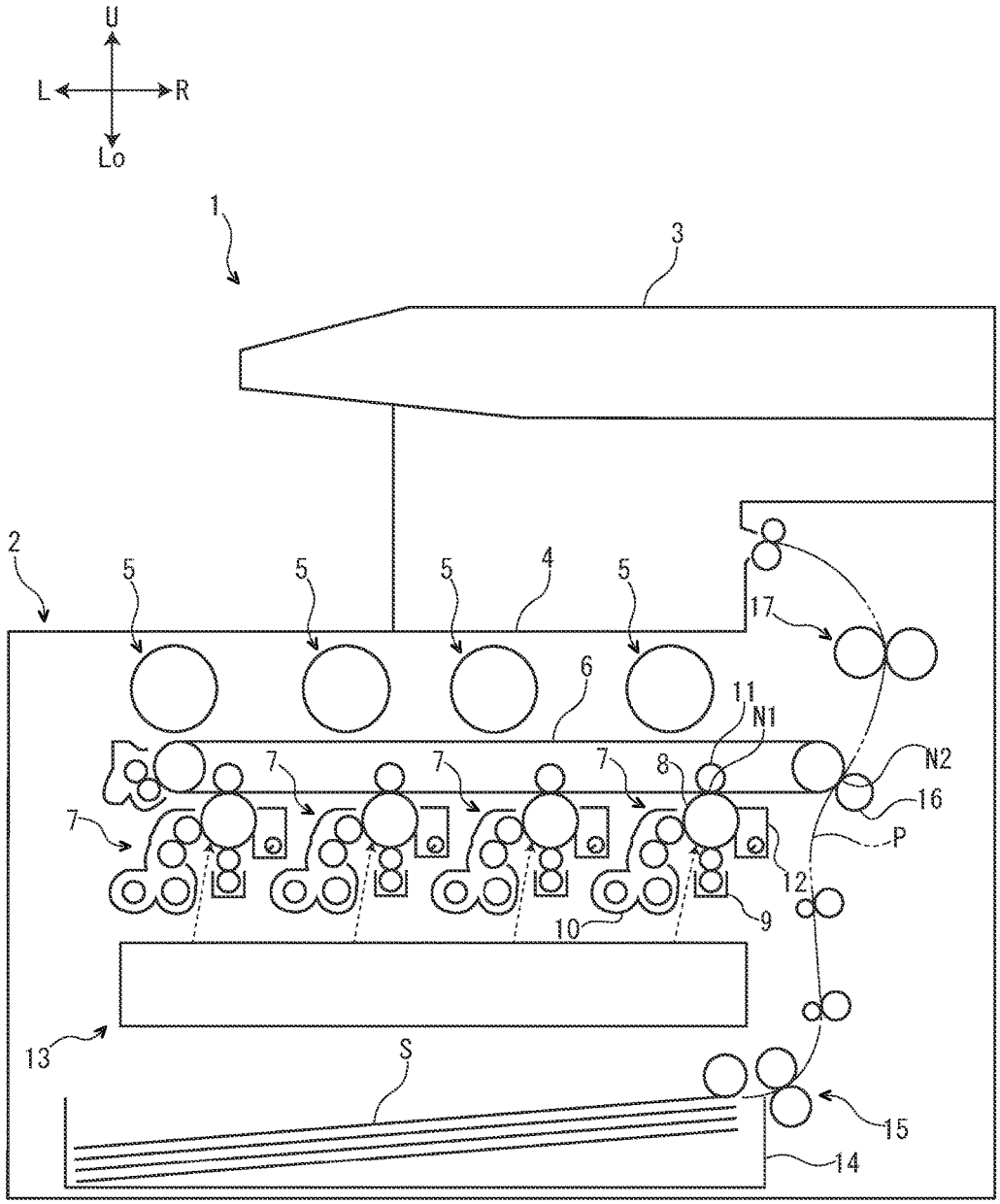
FIG. 1 is a schematic view showing an image forming apparatus according to an embodiment of the present disclosure.

As shown in FIG. 1, the image forming apparatus 1 includes a box-shaped apparatus main body 2. On an upper end portion of the apparatus main body 2, an image reading device 3 configured to read an image of a document is provided. In an upper portion of the apparatus main body 2, an ejected sheet tray 4 is provided below the image reading device 3. In the upper portion of the apparatus main body 2, four toner containers 5 are provided below the ejected sheet tray 4. The four toner containers 5 respectively store a yellow toner, a magenta toner, a cyan toner and a black toner.

In an approximate center portion of the apparatus main body 2, an intermediate transferring belt 6 is stored below the four toner containers 5. In the approximate center portion of the apparatus main body 2, four image forming parts 7 are stored below the intermediate transferring belt 6. The four image forming parts 7 respectively correspond to the yellow toner, the magenta toner, the cyan toner and the black toner. Each of the image forming parts 7 includes a photosensitive drum 8, a charging device 9, a developing device 10, a primary transferring roller 11 and a cleaning device 12. Between the primary transferring roller 11 and the photosensitive drum 8, the intermediate transferring belt 6 is interposed, and a primary transferring nip N1 is formed between the intermediate transferring belt 6 and the photosensitive drum 8.

In a lower portion of the apparatus main body 2, an exposing device 13 is stored below the four image forming parts 7. In a lower end portion of the apparatus main body 2, a sheet feeding cassette 14 is stored below the exposing device 13. The sheet feeding cassette 14 stores a sheet S (an example of a recording medium).

In a right side portion of the apparatus main body 2, a conveying path P for the sheet S is provided so as to extend from the sheet feeding cassette 14 to the ejected sheet tray 4. At an upstream portion of the conveying path P, a sheet feeding part 15 is provided. At a middle portion of the conveying path P, a secondary transferring roller 16 is provided. Between the secondary transferring roller 16 and the intermediate transferring belt 6, a secondary transferring nip N2 is formed. At a downstream portion of the conveying path P, a fixing device 17 is provided.

Next, an operation of the image forming apparatus 1 having the above configuration will be described.

When the image forming apparatus 1 is directed to start printing, first, the charging device 9 charges a surface of the photosensitive drum 8. Next, laser light (refer to a dotted line in FIG. 1) emitted from the exposing device 13 forms an electrostatic latent image on the surface of the photosensitive drum 8. Then, the developing device 10 supplies the toner to the photosensitive drum 8, the electrostatic latent image formed on the surface of the photosensitive drum 8 is developed, and a toner image is carried on the photosensitive drum 8. The toner image is primarily transferred on a surface of the intermediate transferring belt 6 at the primary transferring nip N1. The above operation is performed at each image forming part 7 to form a full color toner image on the intermediate transferring belt 6. The toner remained on the photosensitive drum 8 is removed by the cleaning device 12.

On the other hand, the sheet S fed from the sheet feeding cassette 14 by the sheet feeding part 15 is conveyed to a downstream side along the conveying path P and enters the secondary transferring nip N2. At the secondary transferring nip N2, the full color toner image formed on the intermediate transferring belt 6 is secondarily transferred on the sheet S. The sheet S on which the toner image is secondarily transferred is conveyed to the downstream side along the conveying path P and enters the fixing device 17. The fixing device 17 fixes the toner image on the sheet S. The sheet S on which the toner image is fixed is ejected on the ejected sheet tray 4.

The image forming apparatus 1 according to the present embodiment includes a drum unit 20 detachably attached to the apparatus main body 2. Hereinafter, the drum unit 20 will be described. An arrow O shown in each figures after FIG. 2 indicates an outside in the front-and-rear direction of the drum unit 20, and an arrow I shown in each figure after FIG. 2 indicates an inside in the front-and-rear direction of the drum unit 20.

Figure 2:
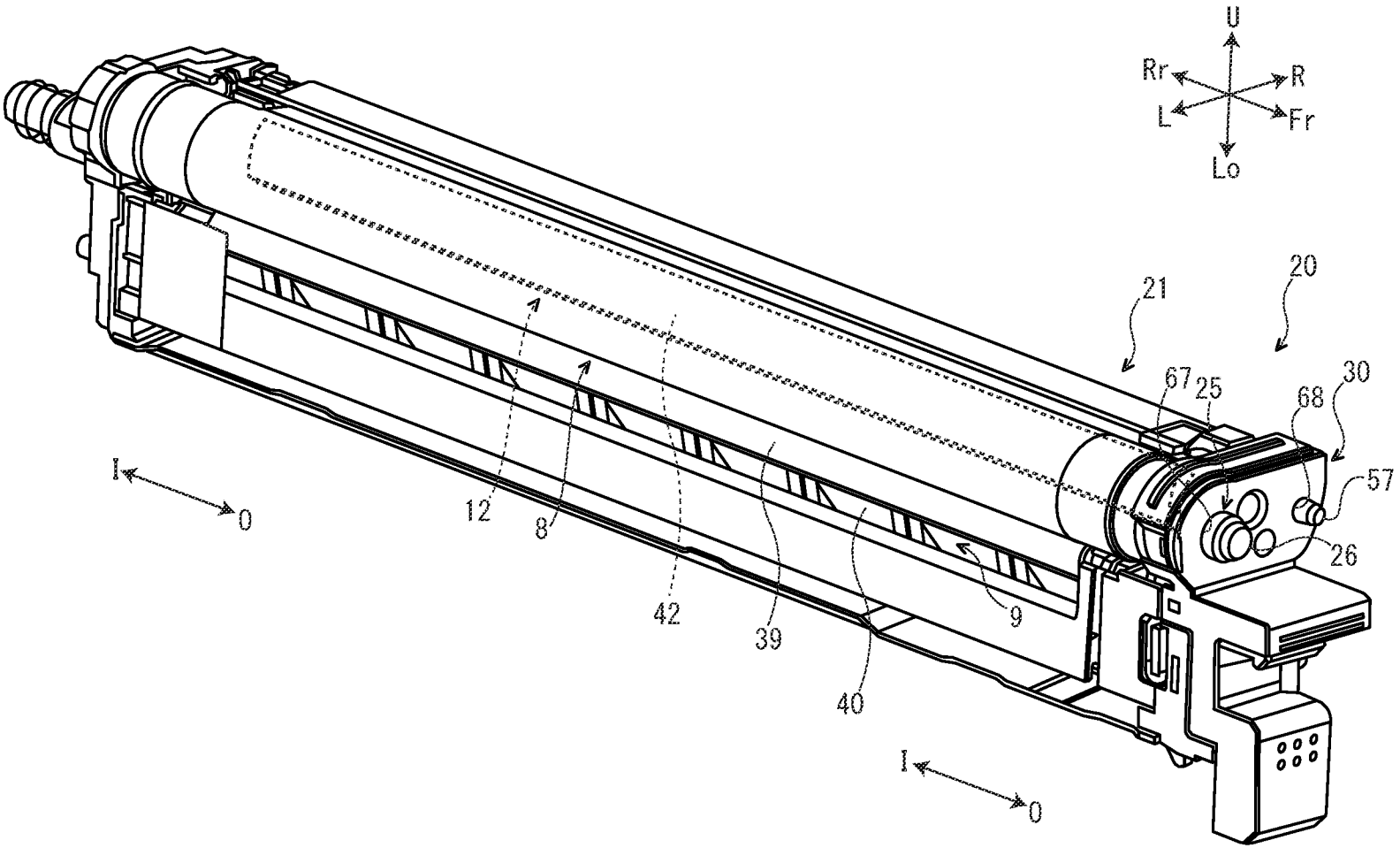
FIG. 2 is a perspective view showing a drum unit according to the embodiment of the present disclosure.
Figure 3:
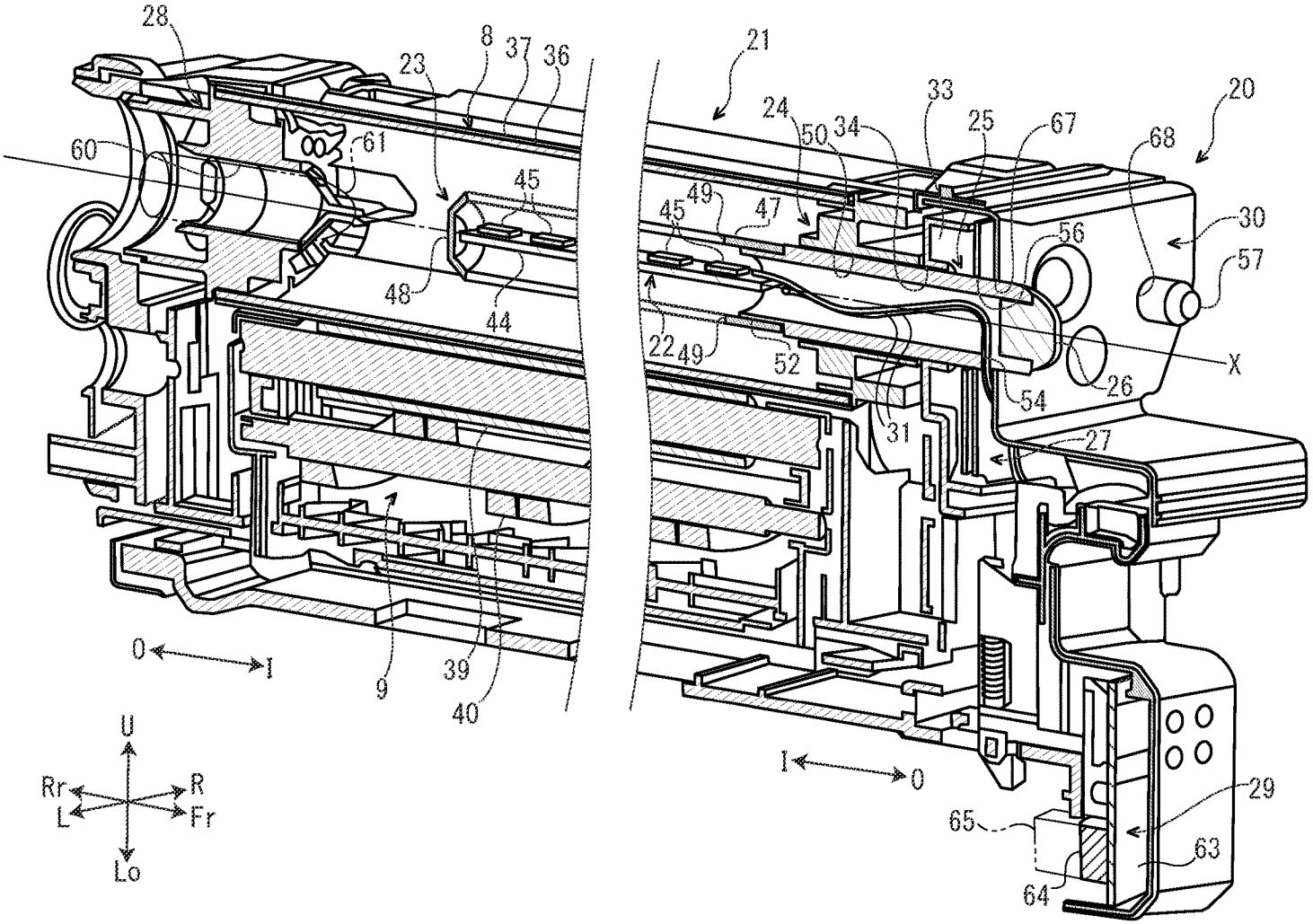
FIG. 3 is a sectional view showing the drum unit according to the embodiment of the present disclosure.

With reference to FIG. 2 and FIG. 3, the drum unit 20 includes a unit main body 21, the photosensitive drum 8 arranged at an upper portion in the unit main body 21, the charging device 9 arranged at a lower side of the photosensitive drum 8, the cleaning device 12 arranged at a right side of the photosensitive drum 8, a heater 22 and a heater cover 23 installed inside the photosensitive drum 8, a front side flange 24 and a supporter 25 and a cap 26 and a metal plate 27 which are arranged at a front end side of the photosensitive drum 8, a rear side flange 28 arranged at a rear end side of the photosensitive drum 8, a connector 29 fixed to a front end portion of the unit main body 21, a main body cover 30 covering a front side of the unit man body 21 and a pair of wires 31 connecting the heater 22 to the connector 29.

The unit main body 21 of the drum unit 20 is formed in a box-like shape with a part of an upper face and a left face opened. At a front portion of the unit main body 21, a frame 33 is provided. At an upper portion of the frame 33, a supporting hole 34 is provided.

The photosensitive drum 8 of the drum unit 20 is formed in a cylindrical shape extending along the front-and-rear direction. The photosensitive drum 8 is rotatable around a rotation axis X extending along the front-and-rear direction. That is, the front-and-rear direction is a rotation axis direction of the photosensitive drum 8.

The photosensitive drum 8 has a diameter of 40 mm or smaller, for example. The photosensitive drum 8 includes a blank tube 36 and a photosensitive layer 37 covering an outer circumference of the blank tube 36. The blank tube 36 is made of metal, such as aluminum and stainless steel. The photosensitive layer 37 is made of amorphous silicon. That is, the photosensitive drum 8 is formed by an amorphous silicon photoreceptor.

The charging device 9 of the drum unit 20 includes a charging roller 39 arranged at the lower side of the photosensitive drum 8 and a cleaning roller 40 arranged at the lower side of the charging roller 39. The charging roller 39 and the cleaning roller 40 extend along the front-and-rear direction. The charging roller 39 comes into contact with the surface of the photosensitive drum 8, and is rotated by following the rotation of the photosensitive drum 8 so as to charge the surface of the photosensitive drum 8 uniformly. The cleaning roller 40 comes into contact with an outer circumferential face of the charging roller 39, and is rotated by following the rotation of the charging roller 39 so as to clean the outer circumferential face of the charging roller 39.

The cleaning device 12 of the drum unit 20 includes a blade 42. The blade 42 extends along the front-and-rear direction. The blade 42 comes into contact with the surface of the photosensitive drum 8, and cleans the surface of the photosensitive drum 8 as the photosensitive drum 8 is rotated.

Figure 4:
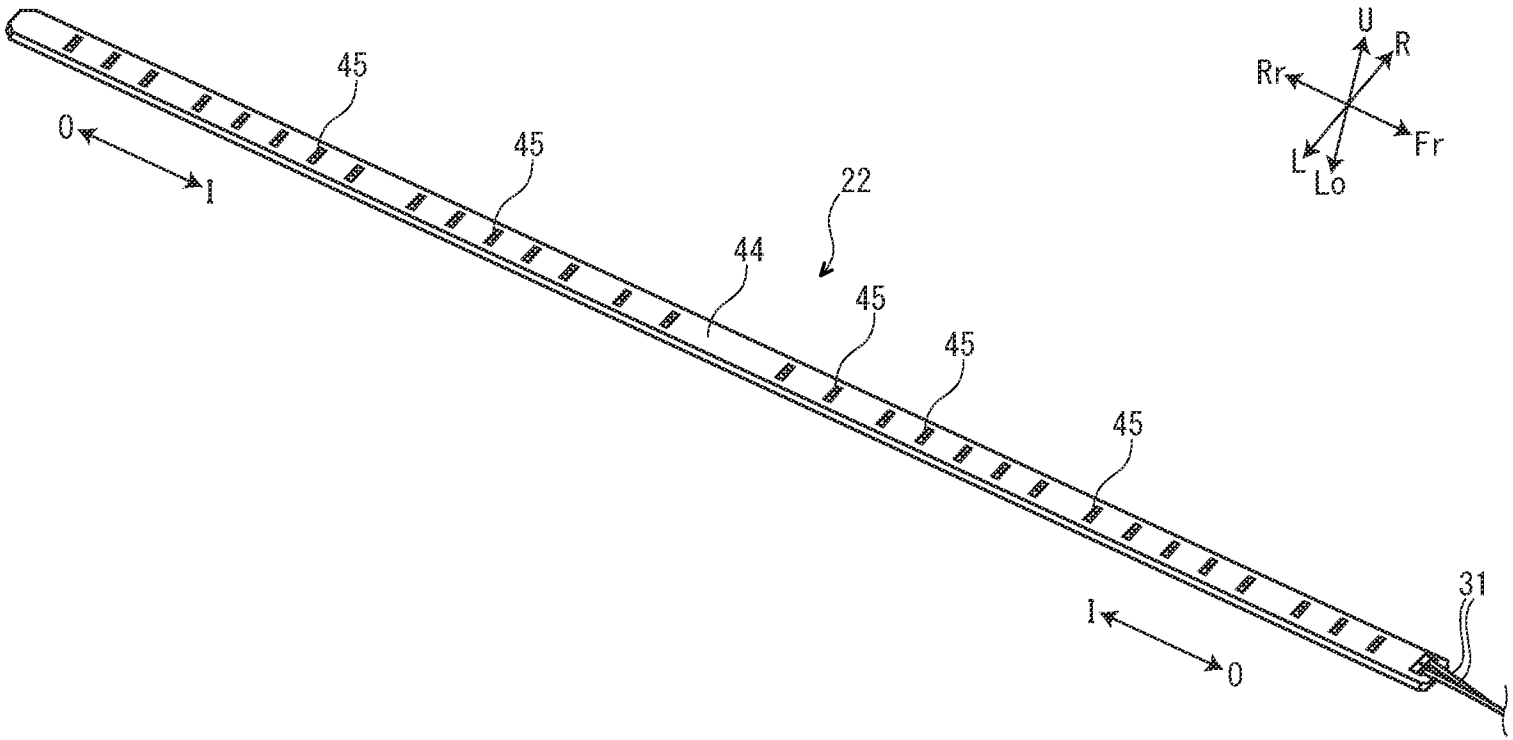
FIG. 4 is a perspective view showing a heater and a pair of wires according to the embodiment of the present disclosure.

With reference to FIG. 3 and FIG. 4, the heater 22 of the drum unit 20 includes a heater substrate 44 and a plurality of resistance elements 45 mounted on the heater substrate 44. The heater substrate 44 is formed in a flat plate shape extending along the front-and-rear direction. The plurality of resistance elements 45 are made of resistance chips. The plurality of resistance elements 45 are aligned in the front-and-rear direction.

Figure 5:
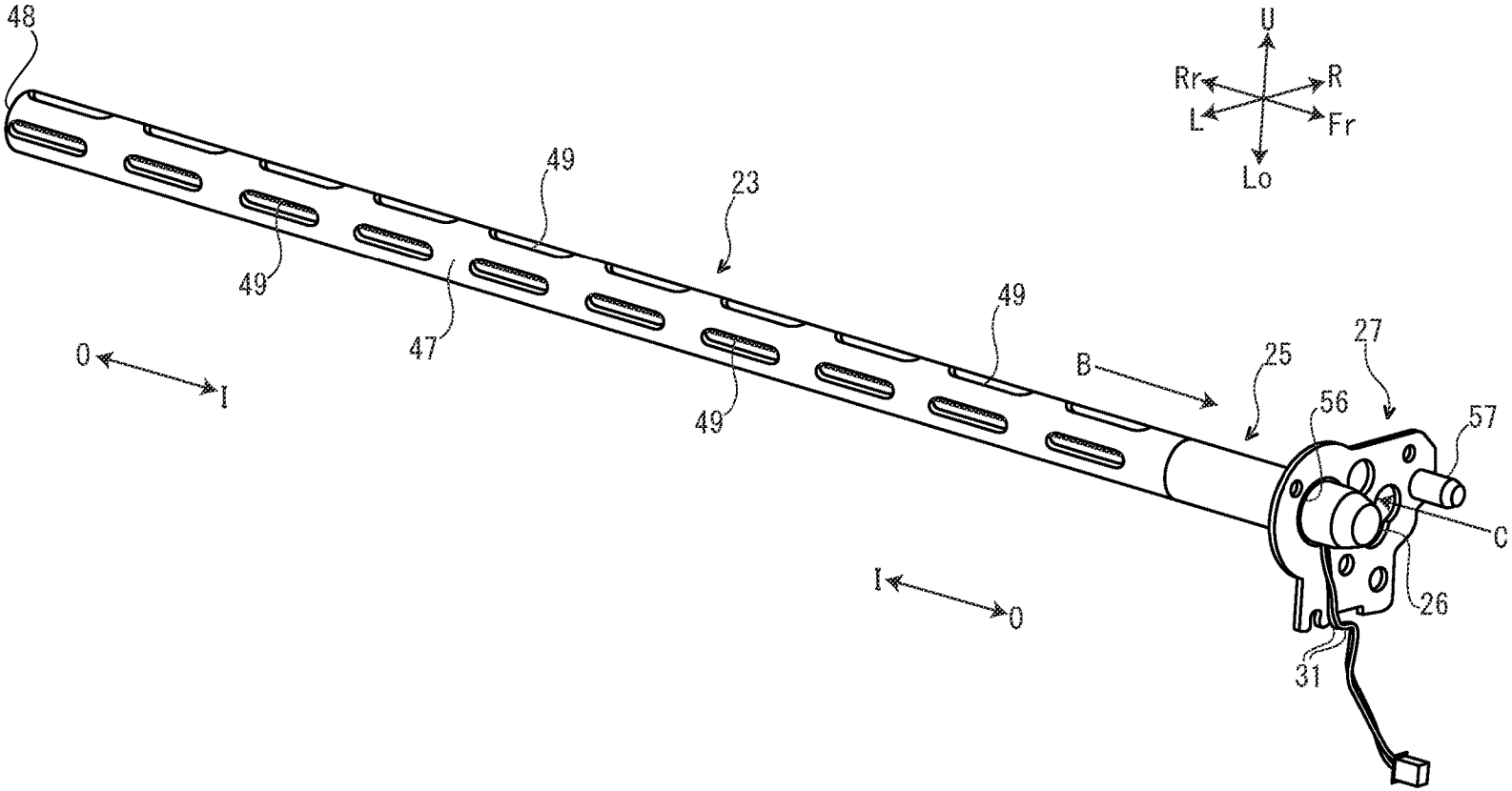
FIG. 5 is a perspective view showing a heater cover, a supporter, a cap, a metal plate and the pair of wires according to the embodiment of the present disclosure.

With reference to FIG. 3 and FIG. 5, the heater cover 23 of the drum unit 20 includes a main body part 47 and a closing part 48 closing a rear end portion of the main body part 47. The main body part 47 is formed in a cylindrical shape with the rotation axis X as a center, and extends along the front-and-rear direction. The main body part 47 covers an outer circumference of the heater 22. The main body part 47 includes a plurality of communication holes 49 through which an inside of the heater cover 23 and an outside of the heater cover 23 communicate with each other. The plurality of communication holes 49 are each formed in a shape elongated in the front-and-rear direction. The plurality of communication holes 49 are provided at intervals in the front-and-rear direction and a circumferential direction. The closing part 48 covers a rear side of the heater 22.

With reference to FIG. 3, the front side flange 24 of the drum unit 20 is formed in an annular shape with the rotation axis X as a center. An outer circumferential portion of the front side flange 24 is attached to a front end portion (an end portion at the outside in the front-and-rear direction) of the photosensitive drum 8. Thereby, the front side flange 24 is rotatable integrally with the photosensitive drum 8. At an inner circumferential portion of the front side flange 24, a through hole 50 is provided.

The supporter 25 of the drum unit 20 is formed in a tubular shape with the rotation axis X as a center, and extends along the front-and-rear direction. The supporter 25 penetrates through the supporting hole 34 of the frame 33. Thereby, the supporter 25 is supported by the frame 33. The supporter 25 penetrates through the through hole 50 of the front side flange 24. Thereby, the supporter 25 rotatably supports the front side flange 24.

Figure 6:
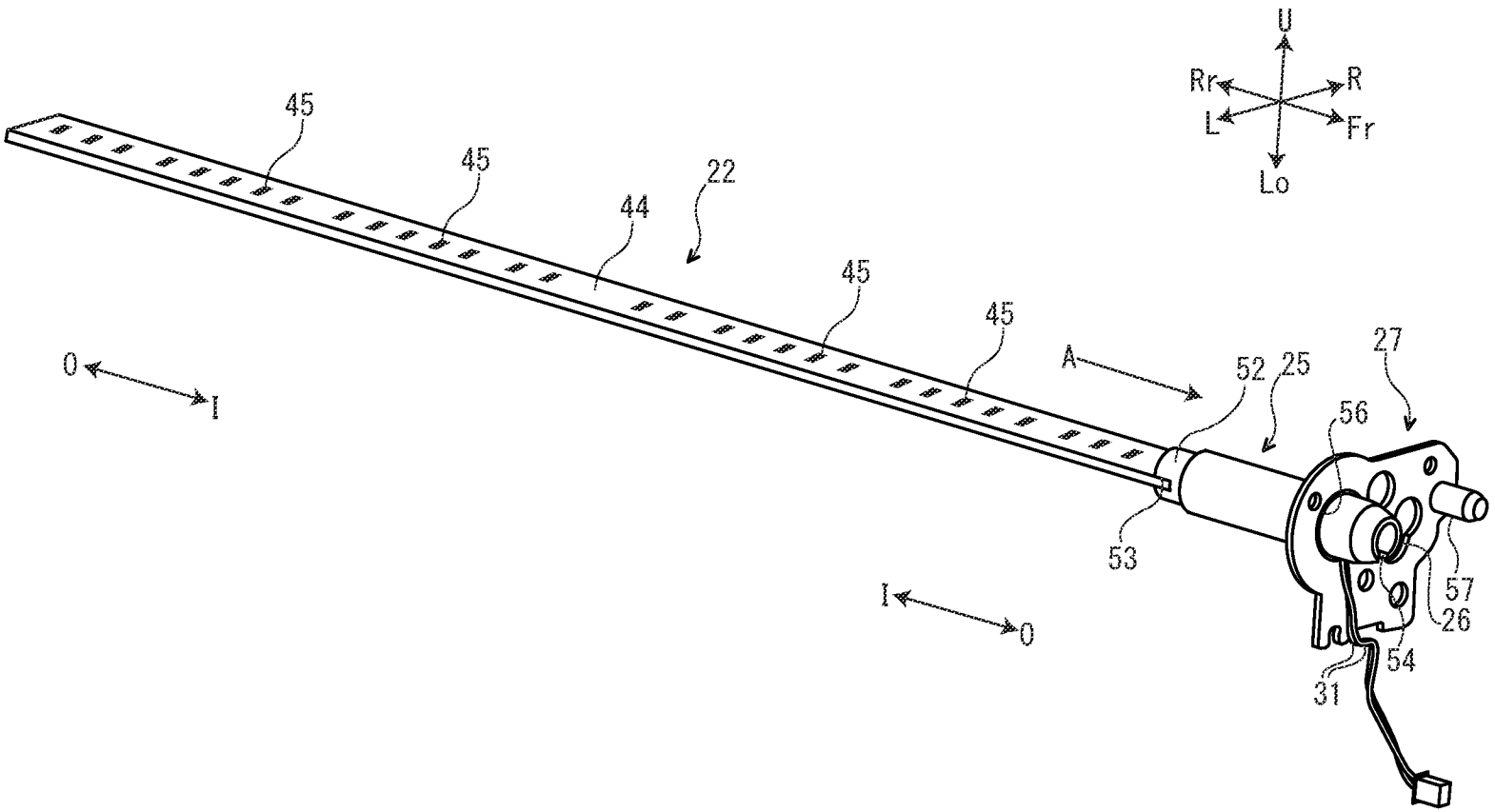
FIG. 6 is a perspective view showing the heater, the supporter, the metal plate and the pair of wires according to the embodiment of the present disclosure.
Figure 7:
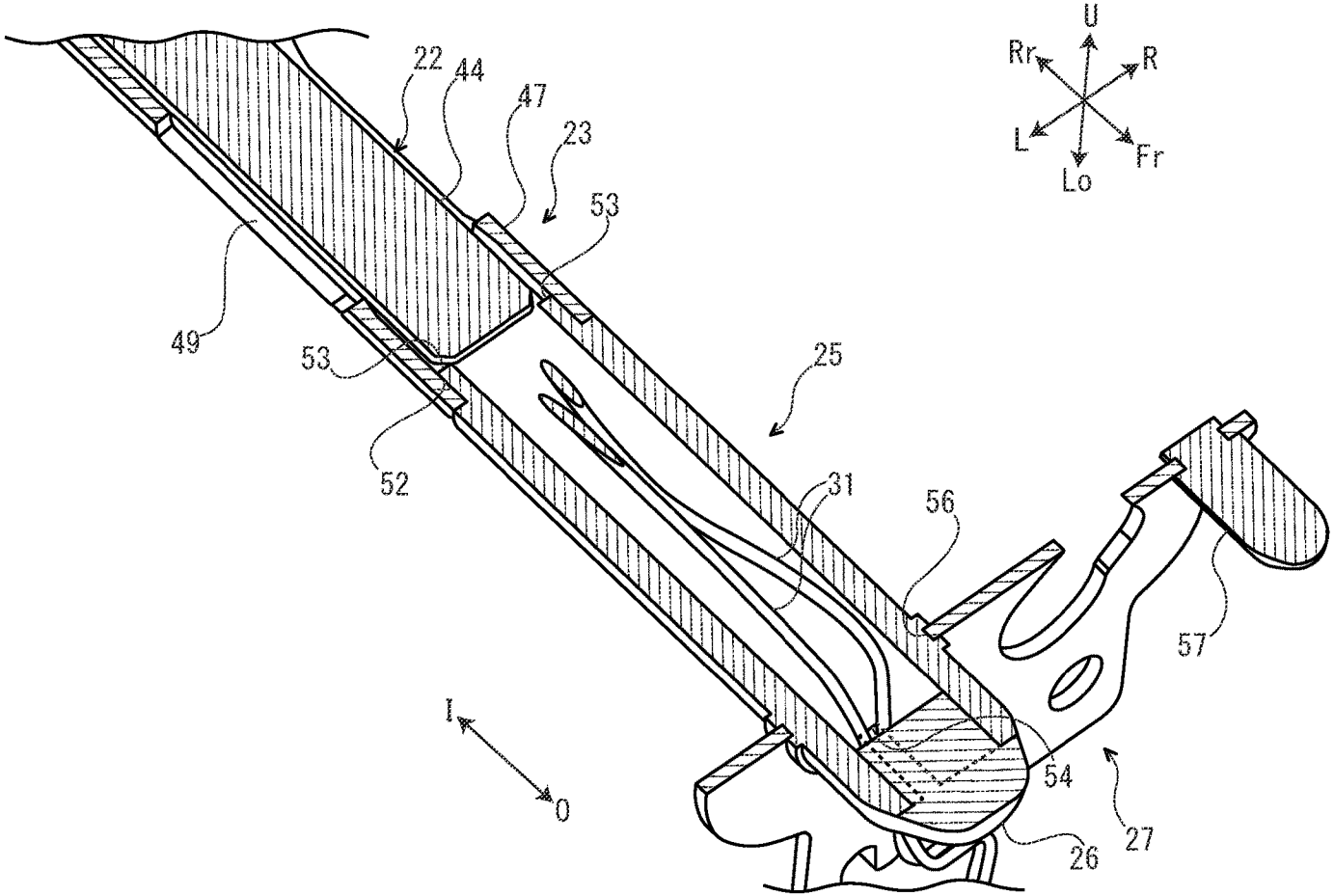
FIG. 7 is a sectional view showing the supporter and its peripheral portion according to the embodiment of the present disclosure.

With reference to FIG. 6 and FIG. 7, on a rear end portion (an end portion at the inside in the front-and-rear direction) of an outer circumferential face of the supporter 25, an annular fitting groove 52 is provided. Into the fitting groove 52, a front end portion (an end portion at the outside in the front-and-rear direction) of the main body part 47 of the heater cover 23 is fitted. Thereby, the supporter 25 supports the heater cover 23 in a cantilever manner. At a rear end portion (an end portion at the inside in the front-and-rear direction) of the supporter 25, a pair of split grooves 53 are provided at both left and right sides of the fitting groove 52. Into the pair of split grooves 53, a front end portion (an end portion at the outside in the front-and-rear direction) of the heater substrate 44 of the heater 22 is inserted. Thereby, the supporter 25 supports the heater 22 in a cantilever manner. At a front end portion (an end portion at the outside in the front-and-rear direction) of the supporter 25, a slit 54 extending along the front-and-rear direction is formed.

With reference to FIG. 7, the cap 26 of the drum unit 20 is attached to the front end portion (the end portion at the outside in the front-and-rear direction) of the supporter 25, and closes a front end portion of the supporter 25. A part of the cap 26 is inserted into the supporter 25.

Figure 8:
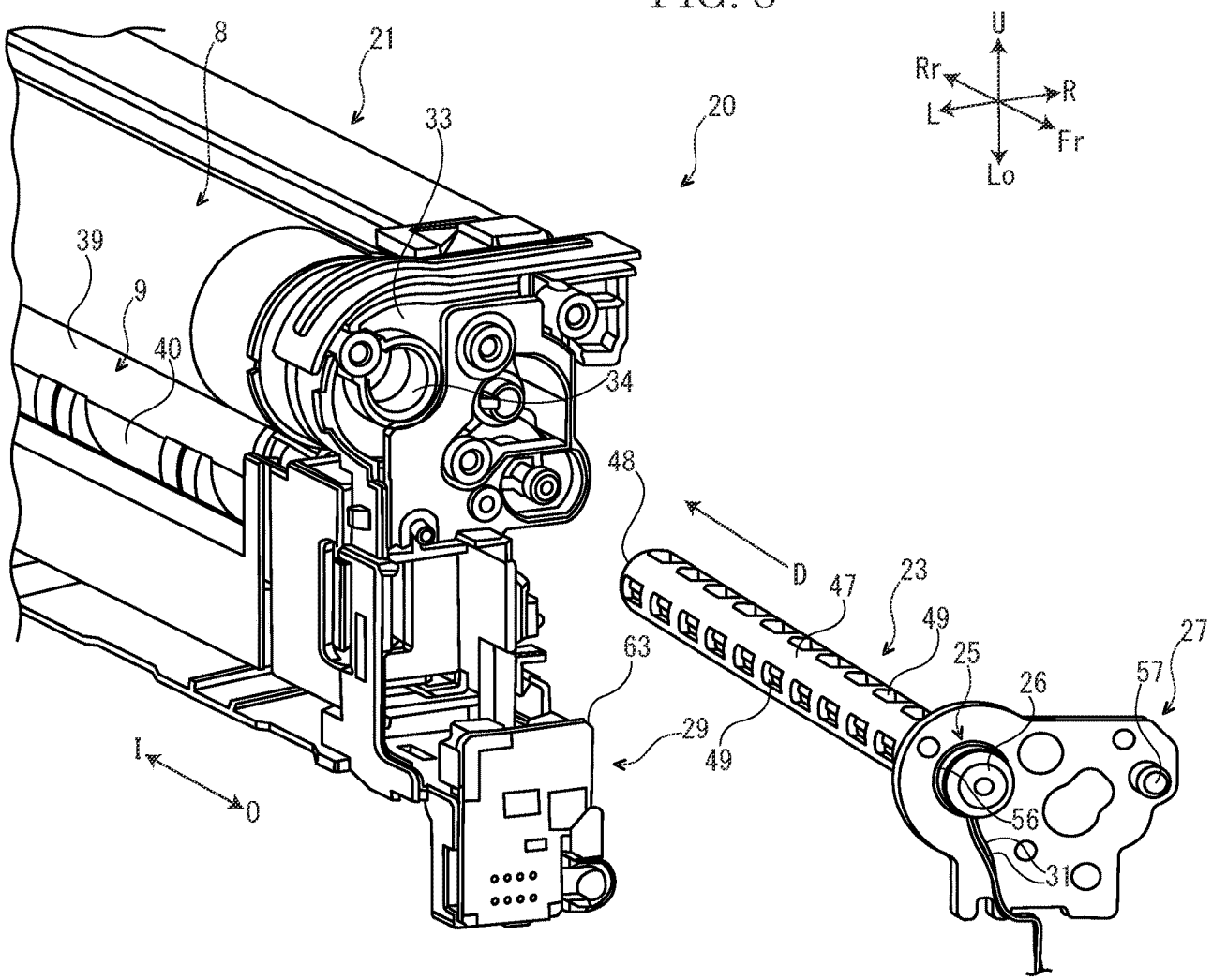
FIG. 8 is a disassembled perspective view showing a front portion of the drum unit according to the embodiment of the present disclosure.
Figure 9:
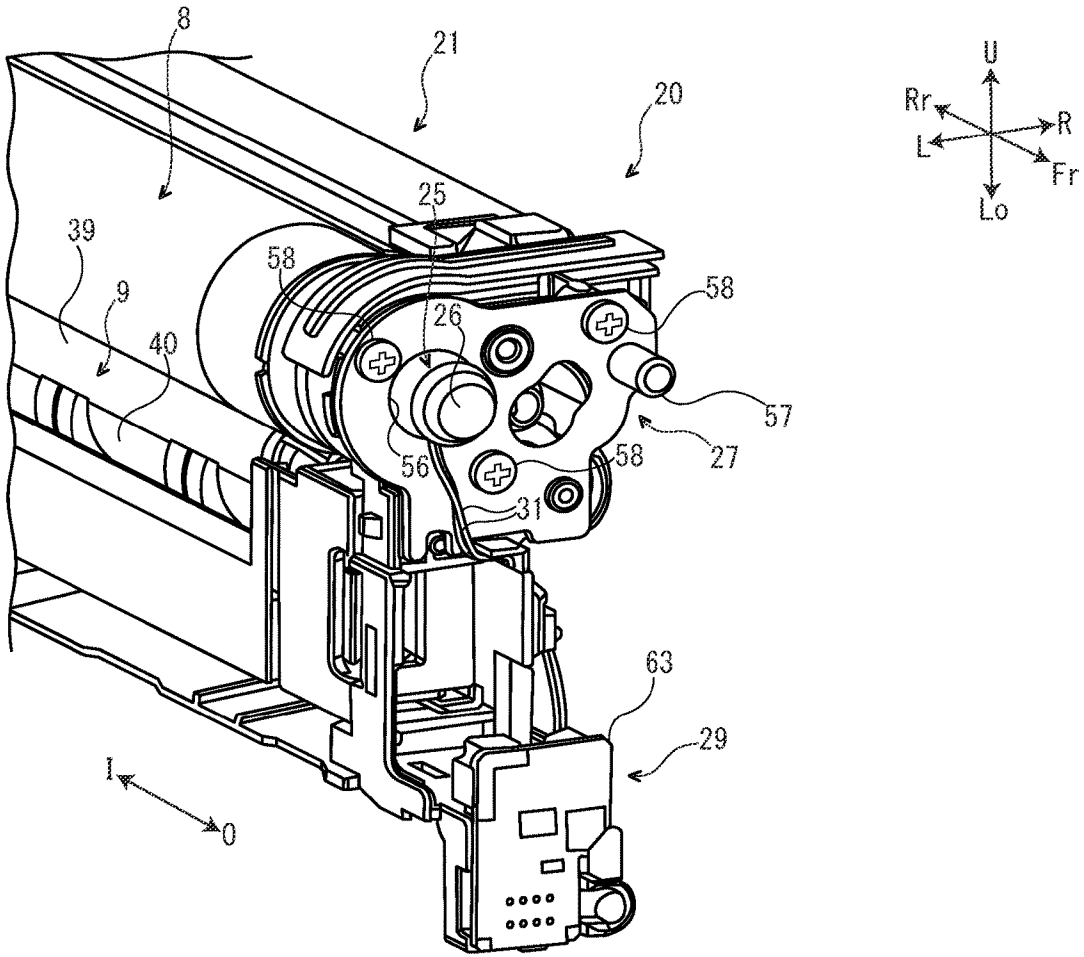
FIG. 9 is a perspective view showing the front portion of the drum unit according to the embodiment of the present disclosure.

With reference to FIG. 5 to FIG. 7, the metal plate 27 of the drum unit 20 is formed in a flat plate shape. The metal plate 27 is provided along a plane perpendicular to the front-and-rear direction. At a left upper portion of the metal plate 27, a fixing hole 56 is provided. Through the fixing hole 56, the supporter 25 penetrates. The metal plate 27 is fixed to the supporter 25 by caulking or welding at a peripheral of the fixing hole 56, and is integrated with the supporter 25. To a right upper portion of the metal plate 27, a pin 57 is fixed. With reference to FIG. 8 and FIG. 9, the metal plate 27 is fixed to the frame 33 by a plurality of screws 58.

With reference to FIG. 3, the rear side flange 28 of the drum unit 20 is formed in an annular shape with the rotation axis X as a center. An outer circumferential portion of the rear side flange 28 is attached to a rear end portion (an end portion at the outside in the front-and-rear direction) of the photosensitive drum 8. Thereby, the rear side flange 28 is rotatable integrally with the photosensitive drum 8. At an inner circumferential portion of the rear side flange 28, a coupling hole 60 is provided. Into the coupling hole 60, a driving joint 61 provided at the apparatus main body 2 is inserted. Thereby, the rear side flange 28 is coupled to the driving joint 61, and the rear side flange 28, the photosensitive drum 8 and the front side flange 24 are rotated around the rotation axis X by following the rotation of the driving joint 61.

The connector 29 of the drum unit 20 is arranged outside the photosensitive drum 8. The connector 29 includes a connector substrate 63 and a unit side terminal 64 fixed to a rear face of the connector substrate 63. The unit side terminal 64 is connected to a main body side terminal 65 provided at the apparatus main body 2.

A lower portion of the main body cover 30 of the drum unit 20 covers a front side of the connector 29. An upper portion of the main body cover 30 covers a front side of the metal plate 27. Ata left upper portion of the main body cover 30, an exposing hole 67 is provided. Through the exposing hole 67, the supporter 25 penetrates. Thereby, the front end portion of the supporter 25 and the cap 26 are exposed to an outside of the drum unit 20.

With reference to FIG. 4, one end portions of the pair of wires 31 of the drum unit 20 are connected to the heater substrate 44 of the heater 22. With reference to FIG. 7, the pair of wires 31 pass through an inside of the supporter 25. The pair of wires 31 pass through the slit 54 of the supporter 25 at the rear side (the inside in the front-and-rear direction) of the cap 26, and is pulled out to an outside of the supporter 25. With reference to FIG. 9, the other end portions of the pair of wires 31 are connected to the connector substrate 63 of the connector 29.

Next, an example of an assembling work of the drum unit 20 will be described.

When the drum unit 20 is assembled, first, as shown by an arrow A in FIG. 6, a worker inserts the front end portion of the heater substrate 44 of the heater 22 into the pair of split grooves 53 of the supporter 25. Thereby, the heater 22 is fixed to the supporter 25. Next, as shown by an arrow B in FIG. 5, the worker fits the front end portion of the main body part 47 of the heater cover 23 into the fitting groove 52 of the supporter 25. Thereby, the heater cover 23 is fixed to the supporter 25. Then, as shown by an arrow C in FIG. 5, the worker attaches the cap 26 to the front end portion of the supporter 25.

Next, as shown by an arrow D in FIG. 8, the worker makes the supporter 25 penetrate through the supporting hole 34 of the frame 33 while inserting the heater 22 and the heater cover 23 into the photosensitive drum 8. Then, as shown in FIG. 9, the worker fixes the metal plate 27 to the frame 33 by the plurality of screws 58. Then, the worker connects the pair of wires 31 to the connector substrate 63 of the connector 29. Finally, as shown in FIG. 2, the worker fixes the main body cover 30 to the unit main body 21. Thereby, the assembling work of the drum unit 20 is finished.

By the way, when the surface of the photosensitive drum 8 is charged by the charging roller 39 at performing the image forming operation, a discharge product may adhere on the surface of the photosensitive drum 8. If the discharge product absorbs moisture, an electric resistance of the surface of the photosensitive drum 8 is lowered, and failure called as image flow may occur.

Then, when the image forming apparatus 1 is used under a high humidity environment, electric power is supplied to the heater 22 through the main body side terminal 65, the connector 29 and the pair of wires 31 from a power source (not shown) provided at the apparatus main body 2. When the electric power is supplied to the heater 22 is powered, the plurality of resistance elements 45 provided at the heater 22 are heated to heat the photosensitive drum 8. Thereby, it becomes possible to vaporize the moisture adhered on the surface of the photosensitive drum 8 and to prevent the discharge product from absorbing the moisture. Accordingly, it becomes possible to prevent the occurrence of the above described image flow.

By the way, when the photosensitive drum 8 is heated by the heater 22 as described above, the heater 22 may be arranged at the outside of the photosensitive drum 8. Specifically, the heater 22 provided in the sheet feeding cassette 14 may be used to heat the photosensitive drum 8, or the heater 22 may be arranged at the lower side of the charging device 9 of the drum unit 20.

However, recently, in view of lowering the heating temperature of the toner in the fixing device 17 and preventing the power consumption of the image forming apparatus 1, the toner is developed to have a lower melting temperature. If the configuration in which the heater 22 is arranged at the outside of the photosensitive drum 8 as described above is applied, the heater 22 heats the developing device 10 arranged near the photosensitive drum 8 in addition to the photosensitive drum 8, and the low melting point toner stored in the developing device 10 may be affected.

In the present embodiment, the heater 22 is installed inside the photosensitive drum 8. By applying such a configuration, it becomes possible to prevent the developing device 10 from being heated and to heat the photosensitive drum 8 intensively. Therefore, if the low melting point toner is used, it becomes possible to prevent thermal deterioration of the toner.

By the way, if the configuration in which the heater 22 is installed inside the photosensitive drum 8 is applied, the heater 22 with a heating coil may be rolled, and then the rolled heater 22 may be inserted in the inside of the photosensitive drum 8.

However, recently, the tandem type image forming apparatus 1 capable of outputting a color image becomes major. As a result, the photosensitive drum 8 is developed to have a small diameter. If the configuration in which the heater 22 with the heating coil is rolled and then the rolled heater 22 is inserted into the inside of the photosensitive drum 8 is applied, because a large space for inserting the heater 22 is required, if a small diameter photosensitive drum 8 (for example, the photosensitive drum 8 having a diameter of 40 mm or smaller) is used, the heater 22 may not be inserted inside the photosensitive drum 8.

In the present embodiment, the heater 22 including the heater substrate 44 extending along the front-and-rear direction and the plurality of resistance elements 45 mounted on the heater substrate 44 is installed inside the photosensitive drum 8. By applying such a configuration, it becomes possible to install the heater 22 inside the photosensitive drum 8 having a small diameter.

As described above, in the present embodiment, regardless of a size of the diameter of the photosensitive drum 8, it becomes possible to install the heater 22 inside the photosensitive drum 8 by a simple structure and to heat the photosensitive drum 8 intensively without heating any mechanism (for example, the developing device 10) arranged near the photosensitive drum 8 unnecessarily.

Additionally, the heater 22 is supported by the supporter 25 penetrating through the front side flange 24. By applying such a configuration, it becomes possible to use the supporter 25 in common for supporting the front side flange 24 rotatably and for supporting the heater 22, and it becomes possible to support the heater 22 by a simple structure.

Additionally, the supporter 25 is formed in a tubular shape, and the pair of wires 31 pass through the inside of the supporter 25. By applying such a configuration, it becomes possible to use the supporter 25 as a guide member for the pair of wires 31, and it becomes possible to guide the pair of wires 31 by a simple structure.

Additionally, the pair of wires 31 pass through the slit 54 of the supporter 25 at the rear side (the inside in the front-and-rear direction) of the cap 26, and then are pulled out to the outside of the supporter 25. By applying such a configuration, it becomes possible to prevent the pair of wires 31 from being fallen from the supporter 25 accidentally.

Additionally, the heater 22 is supported by the supporter 25 in a cantilever manner. By applying such a configuration, it becomes possible to utilize a space formed near the rear end portion of the photosensitive drum 8 as an arrangement space for members (for example, the rear side flange 28 and the driving joint 61) to input the driving force to the photosensitive drum 8.

Additionally, the metal plate 27 is fixed to the frame supporting the supporter 25. By applying such a configuration, it becomes possible to improve a positional precision of the supporter 25 with respect to the frame 33.

Additionally, the photosensitive drum 8 is formed by an amorphous silicon photoreceptor. By applying such a configuration, compared with a case where the photosensitive drum 8 is formed by an organic photoreceptor, it becomes possible to prevent an abrasion of the photosensitive drum 8 and to prolong the lifetime of the photosensitive drum 8. On the other hand, in a case where the photosensitive drum 8 is formed by an amorphous silicon photoreceptor, compared with a case where the photosensitive drum 8 is formed by an organic photoreceptor, because the photosensitive drum 8 is hardly scraped, the moisture adhered on the surface of the photosensitive drum 8 is hardly removed and the image flow easily occurs. Then, heating the photosensitive drum 8 by using the above heater 22 provides a merit preventing the occurrence of the image flow.

Additionally, the image forming apparatus 1 includes the above described drum unit 20 and the apparatus main body 2 to which the drum unit 20 is attached. By applying such a configuration, it becomes possible to prevent the occurrence of the image flow and to improve an image quality of an output image.

In the present embodiment, the heater 22 is supported by one supporter 25 in a cantilever manner. On the other hand, in another embodiment, the heater 22 may be supported by two supporters 25 from its both sides.

In the present embodiment, the heater 22 is installed inside the photosensitive drum 8 having a diameter of 40 mm or smaller. On the other hand, in another embodiment, the heater 22 may be installed inside the photosensitive drum 8 having a diameter exceeding 40 mm.

In the present embodiment, the image forming apparatus 1 is a multifunctional peripheral. In another embodiment, the image forming apparatus 1 may be a printer, a copying machine and a facsimile.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A drum unit comprising:

a photosensitive drum rotating around a rotation axis extending along a rotation axis direction; and a heater installed inside the photosensitive drum and heating the photosensitive drum, wherein the heater includes:

a heater substrate extending along the rotation axis direction; and a plurality of resistance elements aligned in the rotation axis direction and mounted on the heater substrate, the drum unit further comprising:

a flange attached to an end portion of the photosensitive drum at an outside in the rotation axis direction; and a supporter extending along the rotation axis direction and penetrating through the flange, wherein the heater is supported by the supporter, the drum unit further comprising:

a connector arranged at an outside of the photosensitive drum; and a wire connecting the heater to the connector, wherein the supporter is formed in a tubular shape, the wire passes through an inside of the supporter, the heater is supported by the supporter in a cantilever manner, the drum unit further comprising a cylindrical heater cover covering an outer circumference of the heater, on an end portion at an inside in the rotation axis direction of an outer circumferential face of the supporter, an annular fitting groove is provided, and an end portion at the outside in the rotation axis direction of the heater cover is fitted into the fitting groove, and at an end portion at the inside in the rotation axis direction of the supporter, a pair of split grooves are provided at both sides of the fitting groove, and an end portion at the outside in the rotation axis direction of the heater substrate is inserted into the pair of split grooves.

2. The drum unit according to claim 1, further comprising a cap attached to an end portion of the supporter at the outside in the rotation axis direction, wherein the supporter has a slit extending along the rotation axis direction, and the wire passes through the slit at an inside of the cap in the rotation axis direction and is pulled out to an outside of the supporter.

3. The drum unit according to claim 1, further comprising:

a frame supporting the supporter; and a metal plate integrated with the supporter, wherein the metal plate is fixed to the frame.

4. The drum unit according to claim 1, wherein the photosensitive drum is formed by an amorphous silicon photoreceptor.

5. The drum unit according to claim 1, wherein the heater cover has a plurality of communication holes through which an inside of the heater cover and an outside of the heater cover communicate with each other, and the plurality of communication holes are provided at intervals in the rotation axis direction and a circumferential direction.

6. An image forming apparatus comprising:

the drum unit according to claim 1; and an apparatus main body to which the drum unit is attached.

7. The drum unit according to claim 1, wherein the heater cover includes:

a main body part configured to cover an outer circumference of the heater; and a closing part configured to close an end portion in the rotation axis direction of the main body part.

* * * * *